United States Patent [19]

Sears et al.

[11] Patent Number: 4,762,233

[45] Date of Patent: Aug. 9, 1988

[54] CONTRACTING CONTAINER

[76] Inventors: Jack L. Sears, c/o George Spector, 233 Broadway RM 3815; George Spector, 233 Broadway RM 3815, both of New York, N.Y. 10007

[21] Appl. No.: 54,220

[22] Filed: May 26, 1987

[51] Int. Cl.[4] ..... B65D 3/26

[52] U.S. Cl. ..... 206/627; 206/606; 206/612; 206/628

[58] Field of Search ..... 206/606, 611, 612, 620, 206/627, 628, 634; 220/319

[56] References Cited

U.S. PATENT DOCUMENTS

| | | | |
|---|---|---|---|
| 1,560,681 | 11/1925 | Fisher | 206/611 |
| 3,128,031 | 4/1964 | Dembo | 229/7 R |
| 3,276,574 | 10/1966 | Meyers | 206/627 |
| 3,967,773 | 7/1976 | Kaufmann | 206/612 |
| 4,349,110 | 9/1982 | Hayashi | 206/606 |

FOREIGN PATENT DOCUMENTS

| | | | |
|---|---|---|---|
| 2195969 | 3/1974 | France | 206/602 |

*Primary Examiner*—Stephen Marcus
*Assistant Examiner*—Gary E. Elkins

[57] ABSTRACT

A collapsible container is provided and consists of a cylindrical side wall having a plurality of spaced apart score lines to form container sections with overlapping sealed end portions, a bottom, a removable cover, and a plurality of tab portions formed on the outer end of the outermost end portions. A person may grip each successive uppermost tab portion to peel away each successive uppermost container section along score line.

1 Claim, 1 Drawing Sheet

CONTRACTING CONTAINER

BACKGROUND OF THE INVENTION

The instant invention relates generally to packages and more specifically it relates to a collapsible container.

Numerous packages have been provided in prior art that are adapted to contain removable sections while contents of the packages are consumed therefrom. For example, U.S. Pat. Nos. 2,179,504; 2,210,302 and 2,852,179 all are illustrative of such prior art. While these units may be suitable for the particular purpose to which they address, they would not be as suitable for the purposes of the present invention as heretofore described.

SUMMARY OF THE INVENTION

A primary object of the present invention is to provide a collapsible container that will overcome the shortcomings of the prior art devices.

Another object is to provide a collapsible container that will make contents removal easier, less messy, reduce oxidization and storage requirements of remainder of contents.

An additional object is to provide a collapsible container that can be produced in any shape and size and in any material including plastic and cardboard.

A further object is to provide a collapsible container that is simple and easy to use.

A still further object is to provide a collapsible container that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
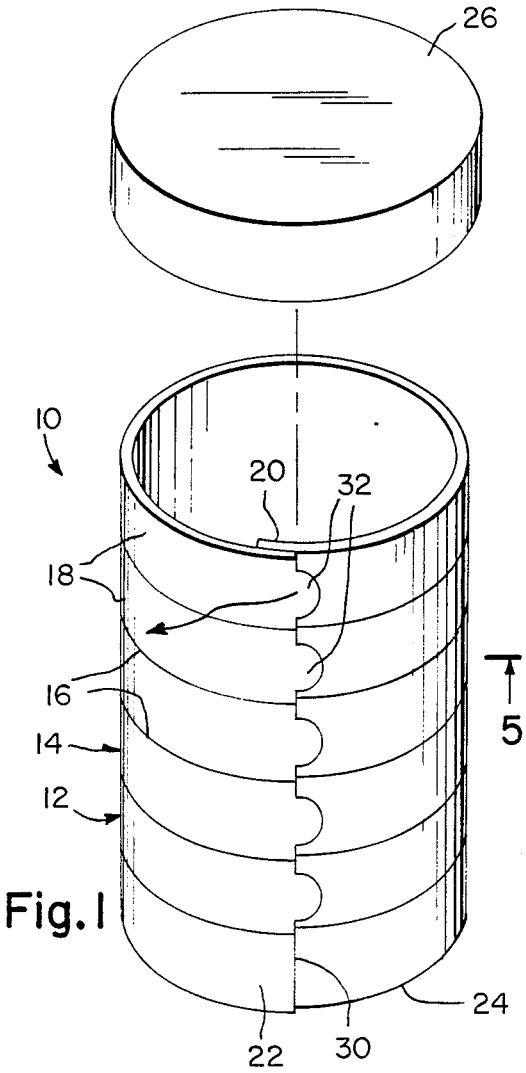
FIG. 1 is a perspective view of the invention with lid exploded therefrom.

Turning now descriptively to the drawings, in which similar reference characters denote similar elements throughout the several views, FIG. 1 illustrates a collapsible container 10 that consists of a side wall 12 forming an open end cylindrical portion 14. The side wall 12 has a plurality of spaced apart score lines 16 along surface thereof forming a plurality of container sections 18 which are generally parallel to each other and to edge defining open end of the cylindrical portion 14. The side wall 12 includes a pair of overlapping end portions 20 and 22.

Figure 2:
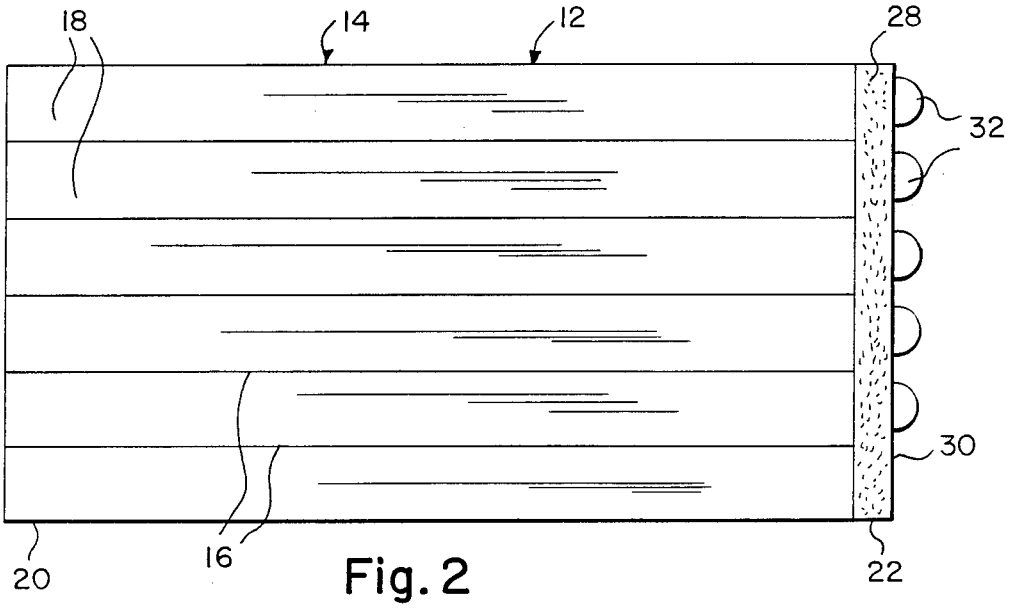
FIG. 2 is a plan view of a blank for forming the container base shown in FIG. 1.

A bottom 24 is provided for the cylindrical portion 14. A removable cover 26 is adapted to be positioned in closing relation to the open end of the cylindrical portion 14. As shown in FIG. 2, the overlapping end portions 20 and 22 are sealed together with adhesive material 28 such as glue or the like, at a position adjacent the outer end 30 of the outermost one 22 of the pair of end portions.

A plurality of tab portions 32 are formed on the outer end 30 of the outermost one 22 of the pair of end portions 30 that a person (not shown) may grasp each successive uppermost tab portion 32 between the fingers and peel away each successive uppermost container section 18 away from rest of the cylindrical portion 14 along the respective score line 16.

Figure 3:
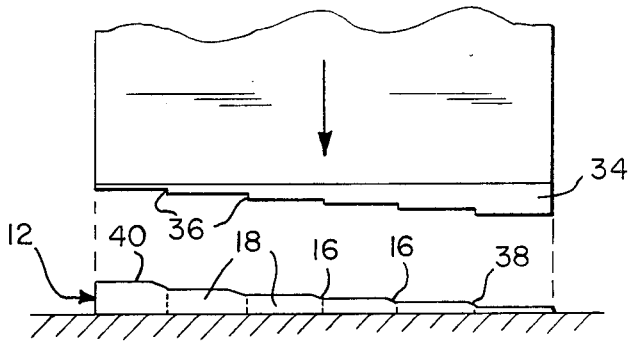
FIG. 3 is an elevational view with parts broken away of a stamping tool forming the score lines and various thicknesses of the container base.

FIG. 3 shows a stamping tool 34 that has a plurality of downwardly decending steps 36 thereon so as to form the plurality of score lines 16 with tapered edges 38 in the side wall 12 and downwardly decending thicknesses in the container sections 18 along internal surface 40 thereof.

Figure 4:
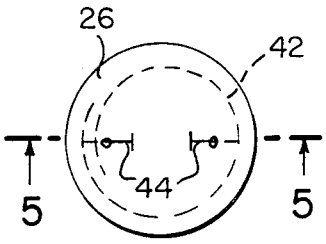
FIG. 4 is a top view of another modification showing a cover with an adjustable inner seal ring.
Figure 5:
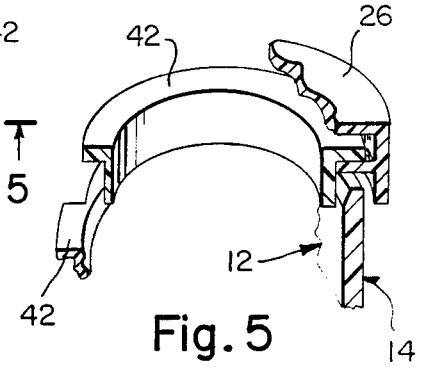
FIG. 5 is a perspective view partly in cross section as taken along line 5—5 in FIG. 4.

FIGS. 4 and 5 show an adjustable inner overlapping seal ring 42 within the removable cover 26 which is adapted to seal the open end of the cylindrical portion 14 when manually operated at 44. Members 44 (FIG. 4) are tabs which when pulled will cause seal ring 42 to contract and overlap thus sealing the container when cover 26 is placed thereover as seen in FIG. 5.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A collapsible container which comprises:

(a) a side wall forming an open end cylindrical portion, said side wall having a plurality of spaced apart score lines along surface thereof forming a plurality of container sections which are generally parallel to each other and to an edge defining an open end of said cylindrical portion, said side wall including an outermost pair of overlapping end portions having outer ends;

(b) a bottom for said cylindrical portion;

(c) a removeable cover which is adapted to be positioned in closing relation to the open end of said cylindrical portion;

(d) means for sealing said overlapping end portions together at a position adjacent said outer ends of said outermost pair of said end portions; and (e) a plurality of tab portions formed on the outer end of the outermost one of said pair of end portions so that a person may grasp each said successive uppermost tab portion between the fingers and peel away each said successive uppermost container section away from rest of said cylindrical portion along said respective score line, wherein said side wall comprises a plurality of downwardly descending steps thereon so as to form said plurality of score lines with tapered edges in said side wall and downwardly descending thickness in said container sections.

* * * * *